US007926621B2

(12) United States Patent
Kawai et al.

(10) Patent No.: US 7,926,621 B2
(45) Date of Patent: Apr. 19, 2011

(54) EVACUATION ASSISTANCE DEVICE FOR ELEVATOR

(75) Inventors: Kiyoji Kawai, Tokyo (JP); Masahiko Konishi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 552 days.

(21) Appl. No.: 12/088,699

(22) PCT Filed: Jan. 18, 2006

(86) PCT No.: PCT/JP2006/300602

§ 371 (c)(1),
(2), (4) Date: Mar. 31, 2008

(87) PCT Pub. No.: WO2007/083364

PCT Pub. Date: Jul. 26, 2007

(65) Prior Publication Data

US 2009/0038892 A1 Feb. 12, 2009

(51) Int. Cl.
*B66B 1/18* (2006.01)

(52) U.S. Cl. ..... 187/387; 187/396; 187/392; 187/313; 187/384

(58) Field of Classification Search ..... 187/247, 187/248, 313, 316, 317, 380–389, 391–393, 187/396

See application file for complete search history.

(56) References Cited

U.S. PATENT DOCUMENTS

| | | | | |
|---|---|---|---|---|
| 4,023,146 | A * | 5/1977 | Carroll | 710/113 |
| 5,979,607 | A * | 11/1999 | Allen | 187/390 |
| 6,000,505 | A * | 12/1999 | Allen | 187/391 |
| 7,182,174 | B2 * | 2/2007 | Parrini et al. | 182/18 |
| 7,210,564 | B2 * | 5/2007 | Kawai | 187/384 |
| 7,677,363 | B2 * | 3/2010 | Kawai | 187/387 |
| 2009/0038892 | A1 * | 2/2009 | Kawai et al. | 187/387 |

FOREIGN PATENT DOCUMENTS

| | | |
|---|---|---|
| JP | 50-90044 | 7/1975 |
| JP | 5 8954 | 1/1993 |
| JP | 8 268656 | 10/1996 |
| JP | 2005-104630 | 4/2005 |
| JP | 2005 104631 | 4/2005 |

OTHER PUBLICATIONS

Sekizawa, A. et al., "Study on Feasibility of Evacuation Using Elevators in a High-Rise Building (Part 1 and Part 2)", pp. 586 to 593, 2004. (with partial English translation).

U.S. Appl. No. 12/066,193, filed Mar. 7, 2008, Hikita, et al.

* cited by examiner

*Primary Examiner* — Jonathan Salata

(74) *Attorney, Agent, or Firm* — Oblon, Spivak, McClelland, Maier & Neustadt, L.L.P.

(57) ABSTRACT

In a building, a service zone including a plurality of floors is set. The building is provided with an elevator that is assigned to the floors in the service zone as service floors. In an event of a fire in the building, an evacuation support apparatus for the elevator controls the operation of the elevator to convey those stranded in the building to an evacuation floor. The evacuation support apparatus has an emergency control device and an evacuation guidance device. The emergency control device has a rescue floor setting portion for setting at least a predetermined one of the service floors as a rescue floor, and an evacuation operation command portion for controlling the elevator such that evacuation operation is performed to vertically reciprocate a car between the rescue floor and the evacuation floor. The evacuation guidance device is installed in the building to impart to those stranded in the building evacuation information including information for specifying the rescue floor, based on information from the emergency control device.

7 Claims, 8 Drawing Sheets

FIG. 6

[THIS FLOOR IS A RESCUE FLOOR.]
YOU CAN EVACUATE
BY ELEVATOR.

FIG. 7

[THIS FLOOR IS A RESCUE FLOOR.]
YOU CANNOT EVACUATE
BY ELEVATOR.

EVACUATION ASSISTANCE DEVICE FOR ELEVATOR

TECHNICAL FIELD

The present invention relates to an evacuation support apparatus for an elevator which serves to evacuate those stranded in a building in case of fire in the building.

BACKGROUND ART

Conventionally, there is proposed a system of operating elevators which is designed to perform control operation individually for each of a plurality of elevator groups to stop cars at nearest floors in the event of a fire in a building in which the plurality of the elevator groups are installed. A priority order for starting control operation is set for each of the elevator groups based on a fire occurrence floor. This control operation starts from the elevator group having a higher set priority. Thus, the duration of normal operation of those of the elevator groups which are not significantly influenced by the fire can be extended (see Patent Document 1).

Patent Document 1: JP 05-8954 A

DISCLOSURE OF THE INVENTION

Problem to be solved by the Invention

However, in the system of operating the elevators disclosed in Patent Document 1, the duration of normal operation of only one or some of the elevator groups can be extended. After the cars have been stopped through control operation, those stranded in the building cannot be conveyed to an evacuation floor, so the efficiency in conveying those stranded in the building in the event of a fire cannot be enhanced.

The present invention has been made to solve the above-mentioned problem, and it is therefore an object of the present invention to provide an evacuation support apparatus for an elevator which makes it possible to enhance the efficiency in conveying those stranded in a building in the event of a fire to an evacuation floor.

Means for Solving the Problem

An evacuation support apparatus for an elevator according to the present invention controls, in an event of a fire in a building provided with an elevator that is assigned to each of a plurality of floors included in a service zone as service floors, an operation of the elevator to convey those stranded in the building to an evacuation floor. The evacuation support apparatus includes: an emergency control device having a rescue floor setting portion for setting at least a predetermined one of the service floors as a rescue floor, and an evacuation operation command portion for controlling the elevator such that evacuation operation is performed to vertically reciprocate a car between the rescue floor and the evacuation floor; and an evacuation guidance device installed in the building, for imparting to those stranded in the building evacuation information including information for specifying the rescue floor, based on information from the emergency control device.

BRIEF DESCRIPTION OF THE DRAWINGS

FIG. 6 is an explanatory diagram showing an example of the contents of the evacuation information indicated by each of the indicators of FIG. 2.

FIG. 7 is an explanatory diagram showing another example of the contents of the evacuation information indicated by each of the indicators of FIG. 2.

BEST MODE FOR CARRYING OUT THE INVENTION

A preferred embodiment of the present invention will be described hereinafter with reference to the drawings.

Embodiment 1

Figure 1:
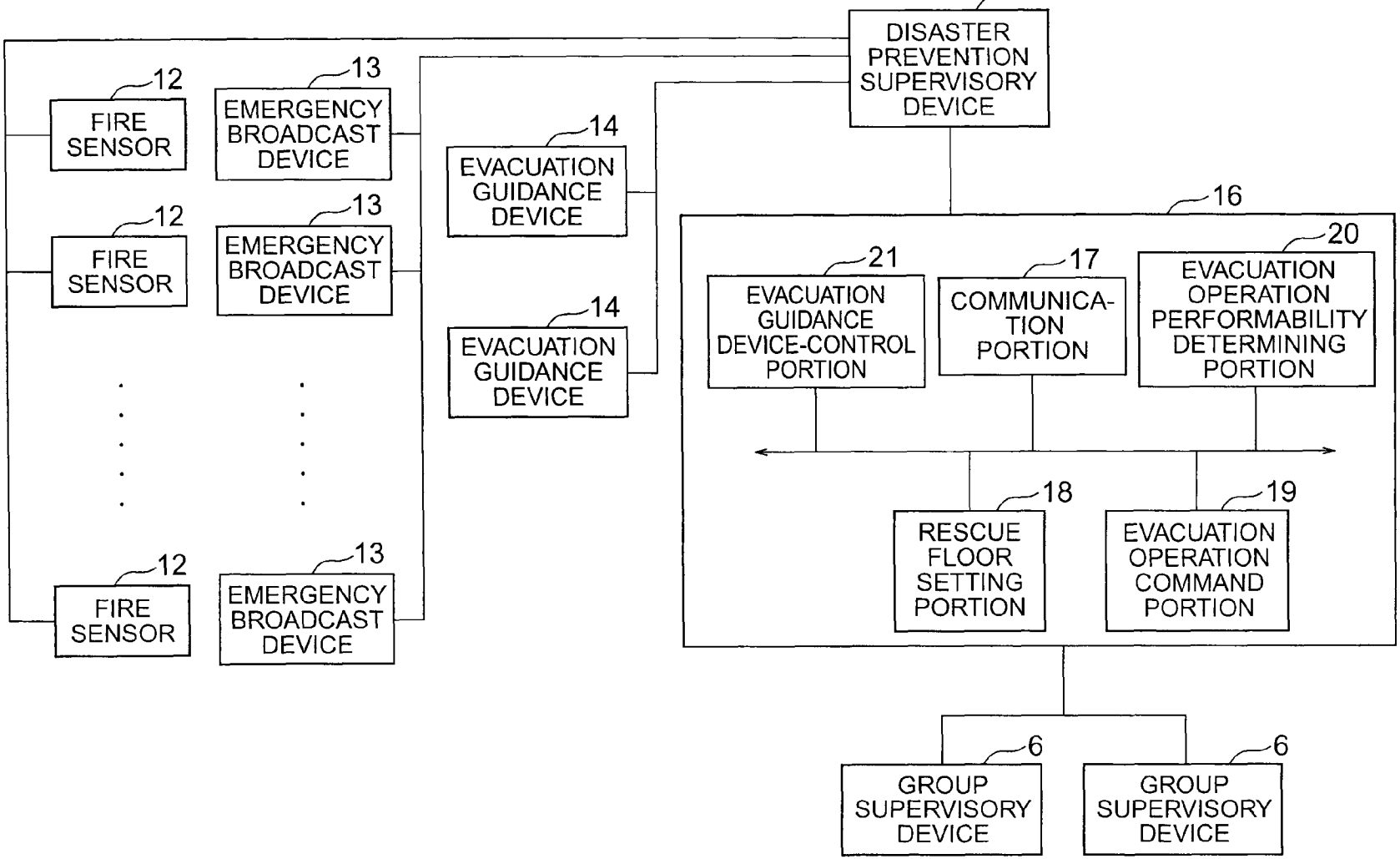
FIG. 1 is a block diagram showing an evacuation support apparatus for elevators according to Embodiment 1 of the present invention.
Figure 2:
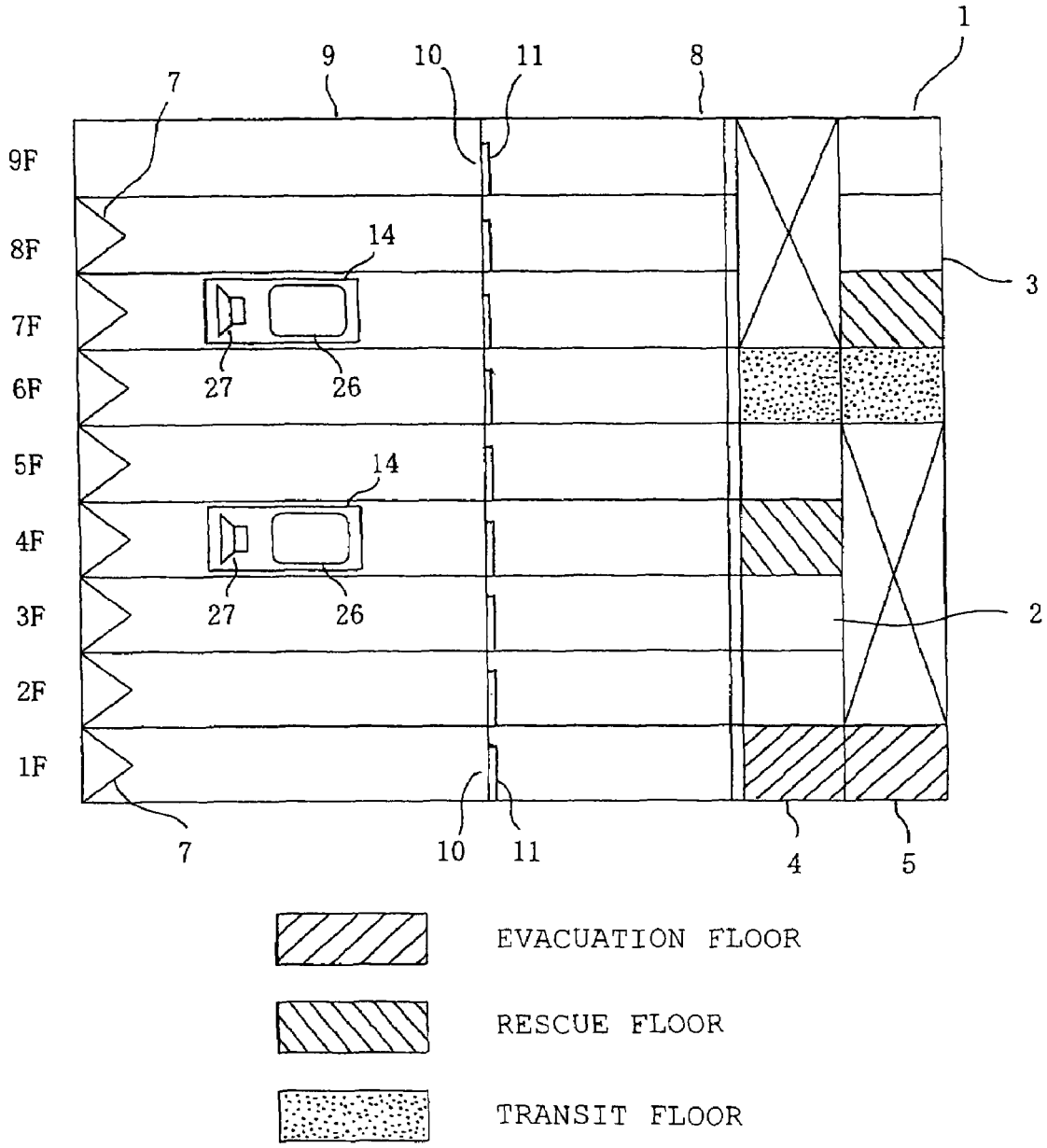
FIG. 2 is a schematic diagram showing a building in which the elevators, which are controlled by the evacuation support apparatus for the elevators shown in FIG. 1, are provided.

FIG. 1 is a block diagram showing an evacuation support apparatus for elevators according to Embodiment 1 of the present invention. FIG. 2 is a schematic diagram showing a building in which the elevators, which are controlled by the evacuation support apparatus for the elevators shown in FIG. 1, are provided. Referring to FIGS. 1 and 2, a building 1 having a plurality of floors (the building of this example stands nine stories above the ground) is provided with a low-layer service zone 2 including the respective floors ranging from the second floor to the sixth floor, and a high-layer service zone 3 including the floors ranging from the sixth floor to the ninth floor. That is, the building 1 is provided with the plurality of (two in this example) service zones 2 and 3 each including the plurality of corresponding ones of the floors such that the floors in one of the service zones 2 and 3 are at least partially different from the floors in the other of the service zones 2 and 3. The building 1 is also provided with a common evacuation floor that is included in neither the service zone 2 nor the service zone 3. In this example, the evacuation floor is the lowest floor of the building 1, that is, the first floor.

In addition, the building 1 is provided with an elevator 4 on a low-layer bank which is assigned to the floors (ranging from the second floor to the sixth floor) included in the low-layer service zone 2 as service floors, and an elevator 5 on a high-layer bank which is assigned to the floors (ranging from the sixth floor to the ninth floor) included in the high-layer service zone 3 as service floors. That is, the building 1 is provided individually with the elevators 4 and 5 that are assigned to the floors included in the service zones 2 and 3 as the service floors, respectively. In this example, the sixth floor, which is included in both the service zones 2 and 3, is serving as a transit floor between the elevators 4 and 5.

Each of the elevators 4 and 5 on the respective banks has a plurality of elevator machines (not shown). Each of the elevator machines in the elevator 4 on the low-layer bank has a car that can be stopped at the service floors in the low-layer service zone 2 and the evacuation floor. Each of the elevator machines in the elevator 5 on the high-layer bank has a car that can be stopped at the service floors in the high-layer service zone 3 and the evacuation floor.

Each of the elevators 4 and 5 on the banks is provided with a group supervisory device 6 (FIG. 1) for controlling the operations of the respective elevator machines. That is, in each of the elevators 4 and 5, the cars are moved individually under the supervision of a corresponding one of the group supervisory devices 6.

The building 1 is also provided with evacuation stairs 7 for helping those stranded in the building 1 to move among the floors. Each of the floors is separated into a corresponding one of elevator regions 8 provided with the elevator 4 or 5, and a corresponding one of stair regions 9 provided with the evacuation stairs 7. An evacuation doorway 10 through which each of the elevator regions 8 communicates with a corresponding one of the stair regions 9, and a fire door 11 capable of opening/closing the evacuation doorway 10 are provided between those regions 8 and 9.

A fire sensor 12 for sensing the occurrence of a fire, and an emergency broadcast device 13 for delivering a broadcast on the occurrence of the fire to the entire building 1 are provided at each of the floors. Each of an evacuation guidance device 14 for guiding those stranded in the building 1 in the event of a fire is provided at predetermined ones of the floors (the fourth floor and the seventh floor in this example). In this example, each of the evacuation guidance devices 14 is provided at the evacuation doorway 10 in a corresponding one of the stair regions 9.

Information from the fire sensors 12 is transmitted to a disaster prevention supervisory device 15 for controlling disaster prevention components in the entire building 1 comprehensively. The disaster prevention supervisory device 15 detects whether or not a fire has occurred, and identifies a fire occurrence floor, based on the information from the fire sensors 12.

Information from the disaster prevention supervisory device 15 is transmitted to an emergency device 16 for controlling the respective group supervisory devices 6 comprehensively in the event of a fire. The emergency control device 16 performs evacuation operation for each of the elevators 4 and 5 to convey those stranded in the building to the evacuation floor after the occurrence of a fire has been detected by the disaster prevention supervisory device 15.

The emergency control device 16 has a communication portion 17, a rescue floor setting portion 18, an evacuation operation command portion 19, an evacuation operation performability determining portion 20, and an evacuation guidance device-control portion 21.

The communication portion 17 allows each of the group supervisory devices 6 and the disaster prevention supervisory device 15 to exchange information with the emergency control device 16.

The rescue floor setting portion 18 sets each of predetermined ones of the service floors as rescue floors as to the service zones 2 and 3. In this example, the rescue floor setting portion 18 sets, for each of the service zones 2 and 3, one rescue floor selected from the service floors included therein.

The rescue floors (predetermined service floors) are specified by separating the building 1 into a plurality of evacuation zones each including a plurality of floors different from the evacuation floor, and setting the lowest floor in each of the evacuation zones other than the lowest evacuation zone as a corresponding one of the rescue floors (predetermined service floors). The number of the evacuation zones is larger than the number of the service zones 2 and 3 by one. That is, in the building 1 provided with elevators on N banks, the respective rescue floors (predetermined service floors) are specified by separating the building 1 into (N+1) evacuation zones, and setting the lowest floors in the N evacuation zones other than the lowest evacuation zone as the predetermined service floors respectively.

In the emergency control device 16, each of the predetermined service floors specified according to the foregoing method is stored in advance as the rescue floors for the service zones 2 and 3. In setting the rescue floors, the rescue floor setting portion 18 reads the respective rescue floors stored in the emergency control device 16.

Figure 3:
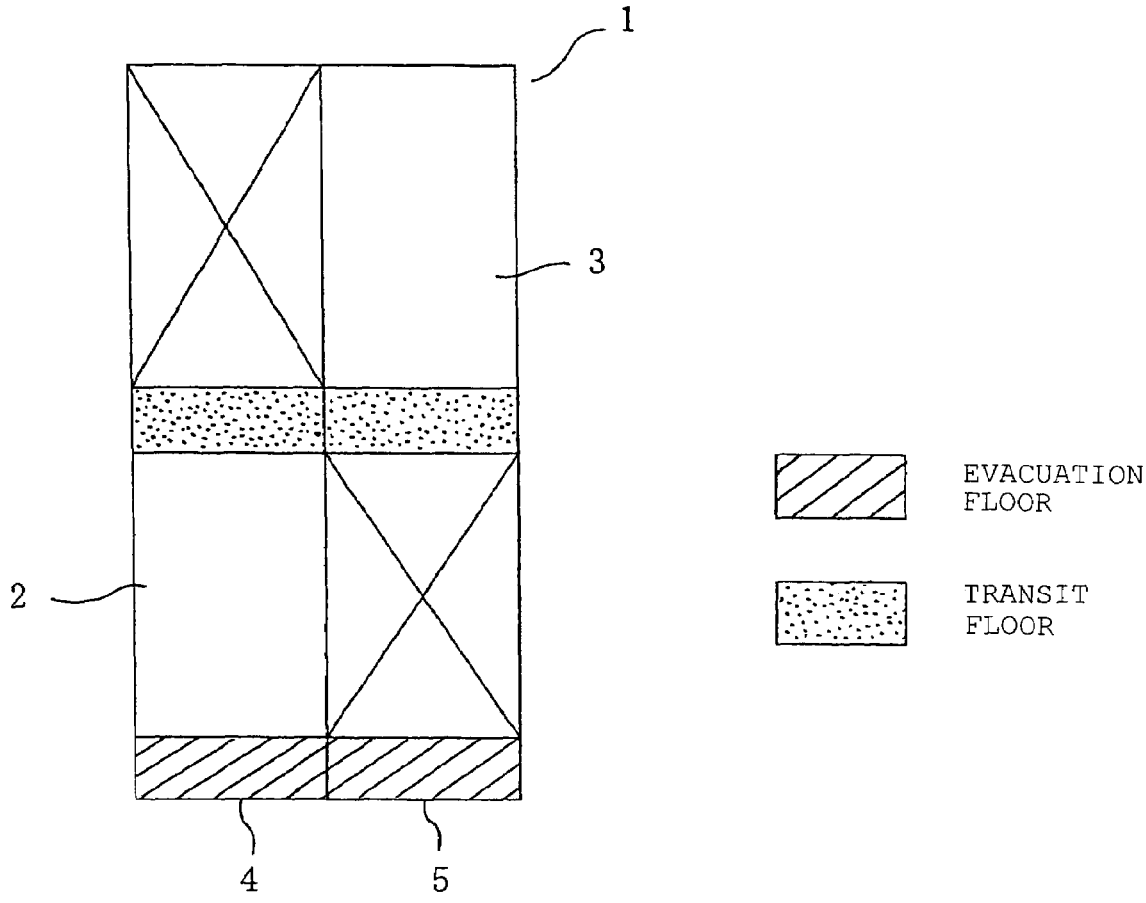
FIG. 3 is a schematic diagram showing the building before the rescue floors are set by the rescue floor setting portion of FIG. 1.
Figure 4:
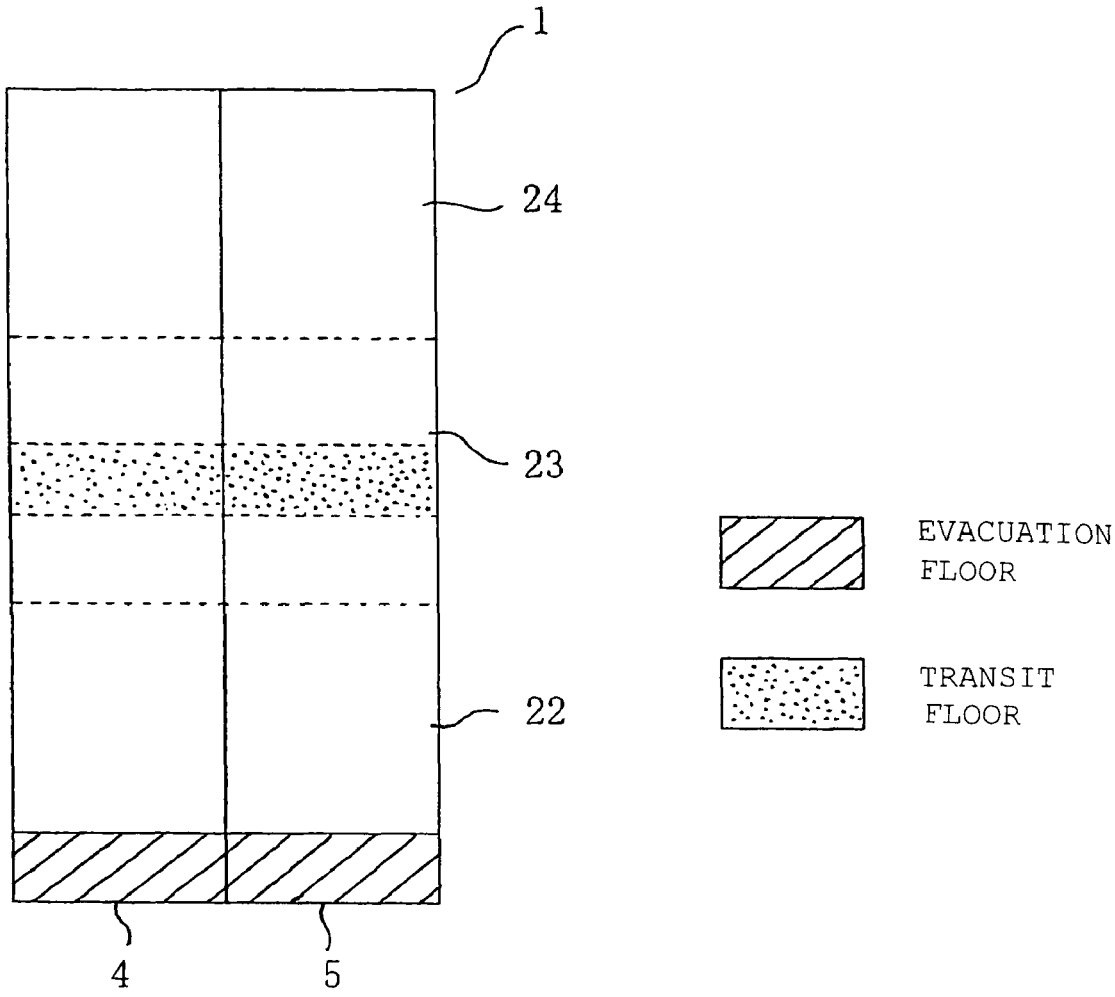
FIG. 4 is a schematic diagram showing a state in which the building of FIG. 3 is separated into the plurality of evacuation zones by the rescue floor setting portion.
Figure 5:
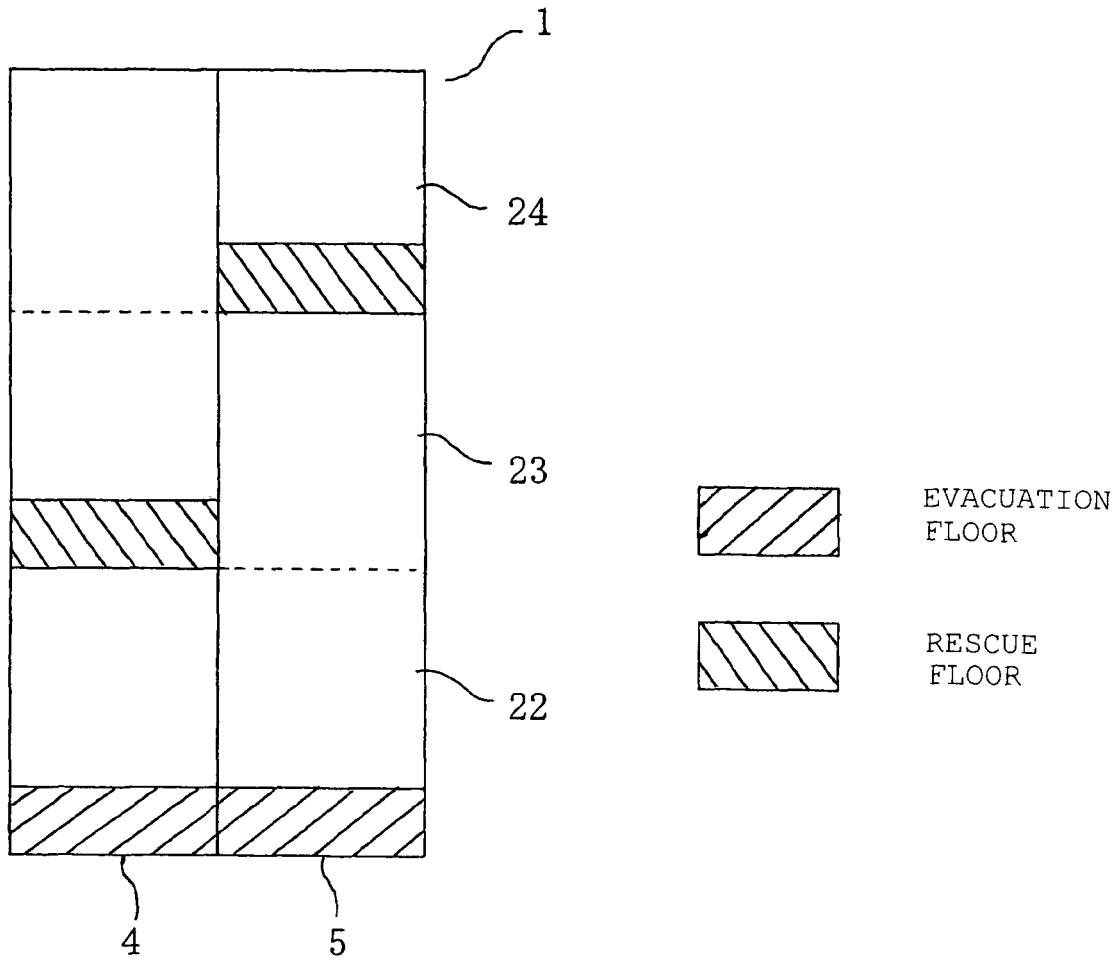
FIG. 5 is a schematic diagram showing a state in which the rescue floors are set in the building of FIG. 4 by the rescue floor setting portion.

FIG. 3 is a schematic diagram showing the building 1 before the rescue floors are set by the rescue floor setting portion 18 of FIG. 1. FIG. 4 is a schematic diagram showing a state in which the building 1 of FIG. 3 is separated into the plurality of evacuation zones by the rescue floor setting portion 18. Further, FIG. 5 is a schematic diagram showing a state in which the rescue floors are set in the building 1 of FIG. 4 by the rescue floor setting portion 18. As shown in FIGS. 3 to 5, the building 1 provided with the two service zones 2 and 3 is separated into three evacuation zones (FIGS. 3 and 4). The lowest floors in the two evacuation zones other than the lowest evacuation zone are set as the rescue floors (predetermined service floors) (FIG. 5). Accordingly, the evacuation floor and the rescue floors are different from one another. Those in each of the evacuation zones of the building move to a corresponding one of the rescue floors located below or the evacuation floor using the stairs.

In this example, a first evacuation zone 22 including the second floor and the third floor, a second evacuation zone 23 including the fourth floor to the sixth floor, and a third evacuation zone 24 including the seventh floor to the ninth floor are set as the respective evacuation zones. Accordingly, the predetermined service floors (rescue floors) are the fourth floor and the seventh floor. Each of the evacuation guidance devices 14 is installed only at the rescue floors.

The evacuation operation command portion 19 outputs to each of the group supervisory devices 6 a command to perform evacuation operation, based on information from the rescue floor setting portion 18. Upon receiving the command to perform evacuation operation from the evacuation operation command portion 19, each of the group supervisory devices 6 controls corresponding ones of the elevator machines such that evacuation operation is performed to vertically reciprocate the corresponding ones of the cars between a corresponding one of the rescue floors and the evacuation floor. During evacuation operation, each of the cars is moved directly between a corresponding one of the rescue floors and the evacuation floor. That is, during evacuation operation, each of the cars is stopped only at a corresponding one of the rescue floors and the evacuation floor, and moves past all the respective floors located between the corresponding one of the rescue floors and the evacuation floor.

The evacuation operation performability determining portion 20 determines whether or not evacuation operation can be performed as to each of the elevators 4 and 5, based on the disaster prevention supervisory device 15 and the information from the rescue floor setting portion 18. That is, the evacuation operation performability determining portion 20 determines whether or not evacuation operation can be performed between each of the rescue floors and the evacuation floor, based on a positional relationship between the rescue floors and the fire occurrence floor. More specifically, the evacuation operation performability determining portion 20 determines that evacuation operation cannot be performed between each of the rescue floors and the evacuation floor when that rescue floor coincides with a floor in the building 1 where the fire is estimated to spread (hereinafter referred to as "the fire spread estimated floor"), that is, the fire occurrence floor, the floor located directly above the fire occurrence floor, or the like, and determines that evacuation operation can be performed between that rescue floor and the evacuation floor when that rescue floor does not coincide therewith. The evacuation operation performability determining portion 20 determines whether or not evacuation operation can be performed, individually as to each of the rescue floors.

The evacuation guidance device-control portion 21 controls the evacuation guidance devices 14 individually, based on the information from the rescue floor setting portion 18 and information from the evacuation operation performability determining portion 20. By being controlled by the evacuation guidance device-control portion 21, the evacuation guidance devices 14 impart to those stranded in the building evacuation information for helping those stranded in the building to reach the evacuation floor in a shorter period of time (information for guiding those stranded in the building). That is, the evacuation guidance device-control portion 21 causes the evacuation guidance devices 14 to impart rescue floor information for specifying the rescue floors based on the information from the rescue floor setting portion 18, and causes the evacuation guidance devices 14 to impart operation performability information on the performability of evacuation operation from the rescue floors based on the information from the evacuation operation performability determining portion 20. In this example, the evacuation information includes the rescue floor information and the operation performability information. A control command from the evacuation guidance device-control portion 21 is transmitted to each of the evacuation guidance devices 14 via the disaster prevention supervisory device 15.

The evacuation guidance devices 14 respectively have indicators 26 for indicating the evacuation information, and speakers (sound emitting devices) 27 for acoustically imparting the evacuation information to those stranded in the building (FIG. 2). Owing to the control of each of the evacuation guidance devices 14 by the evacuation guidance device-control portion 21, a corresponding one of the indicators 26 indicates the evacuation information, and a corresponding one of the speakers 27 emits a sound regarding the evacuation information.

FIG. 6 is an explanatory diagram showing an example of the contents of the evacuation information indicated by each of the indicators 26 of FIG. 2. FIG. 7 is an explanatory diagram showing another example of the contents of the evacuation information indicated by each of the indicators 26 of FIG. 2. FIG. 6 shows the example of the contents of the evacuation information at the time when the evacuation operation performability determining portion 20 determines that evacuation operation from each of the rescue floors can be performed. FIG. 7 shows the example of the contents of the evacuation information at the time when the evacuation operation performability determining portion 20 determines that evacuation operation from each of the rescue floors cannot be performed.

As shown in FIGS. 6 and 7, each of the indicators 26 indicates "THIS IS A RESCUE FLOOR." as the rescue floor information, regardless of whether or not evacuation operation can be performed. Also, each of the indicators 26 indicates "YOU CAN EVACUATE BY ELEVATOR." as the operation performability information when evacuation operation from a corresponding one of the rescue floors can be performed. Each of the indicators 26 indicates "YOU CANNOT EVACUATE BY ELEVATOR." as the operation performability information when evacuation operation from a corresponding one of the rescue floors cannot be performed.

The emergency broadcast devices 13 can announce those stranded in the entire building 1 to evacuate using the evacuation stairs 7 and move according to the evacuation information provided by the evacuation guidance devices 14.

The emergency control device 16 is constituted by a computer having a calculation processing portion (CPU), a storage portion (ROM, RAM, and the like), and signal input/output portions. The functions of the communication portion 17, the rescue floor setting portion 18, the evacuation operation command portion 19, the evacuation operation performability determining portion 20, and the evacuation guidance device-control portion 21 are realized by the computer constituting the emergency control device 16.

That is, programs for realizing the functions of the communication portion 17, the rescue floor setting portion 18, the evacuation operation command portion 19, the evacuation operation performability determining portion 20, and the evacuation guidance device-control portion 21 are stored in the storage portion of the computer. The information on the respective rescue floors and the like is also stored in the storage portion. The calculation processing portion performs a calculation processing regarding the function of the emergency control device 16 based on the programs stored in the storage portion.

Figure 8:
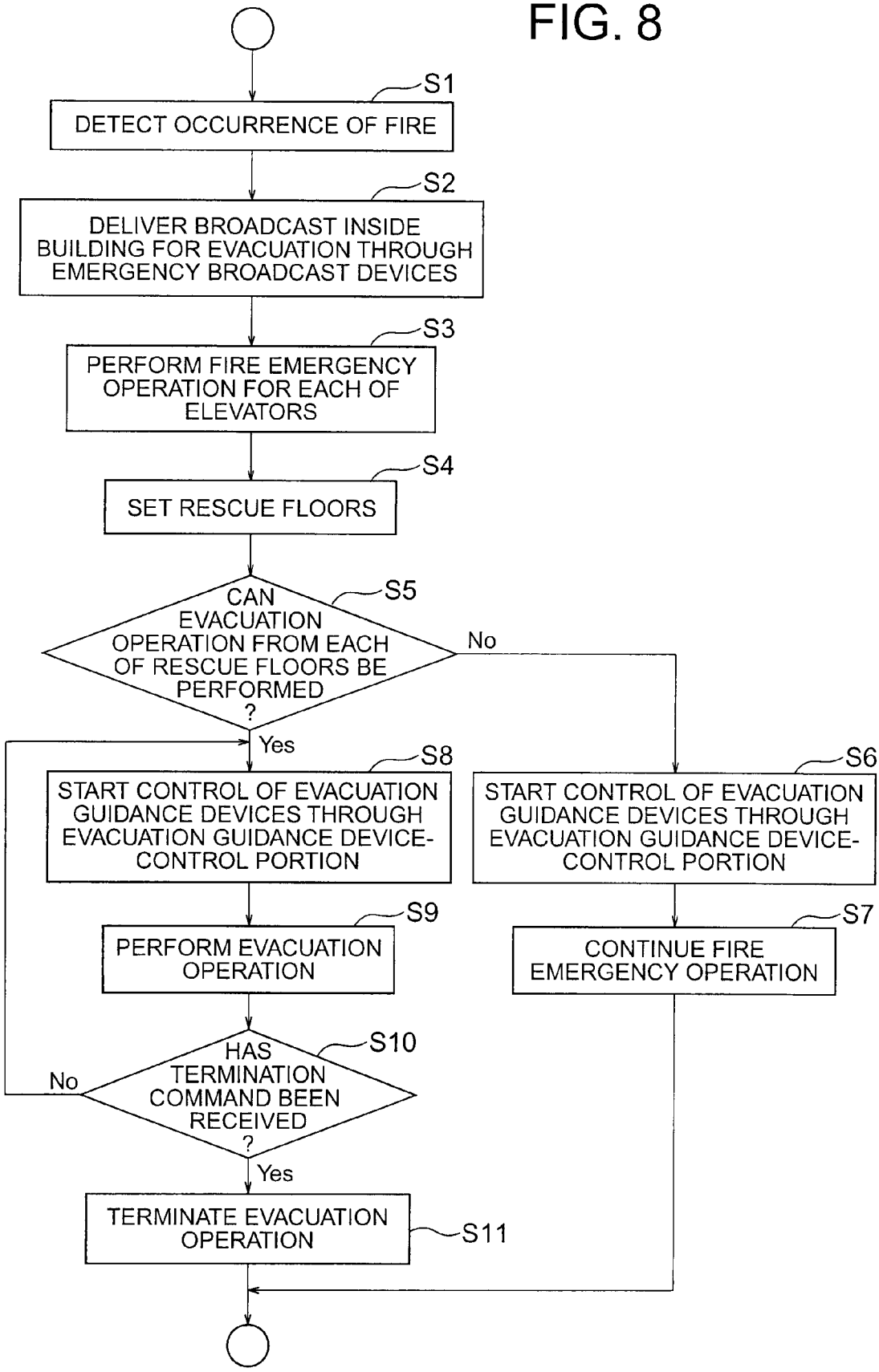
FIG. 8 is a flowchart for explaining the processing operation of the emergency control device of FIG. 1.

Next, description of an operation will be given. FIG. 8 is a flowchart for explaining the processing operation of the emergency control device 16 of FIG. 1. As shown in FIG. 8, when the occurrence of a fire is detected by the disaster prevention supervisory device 15 (S1), a command for delivering an evacuation broadcast for evacuating those stranded in the building is output from the disaster prevention supervisory device 15 to each of the emergency broadcast devices 13 (S2). Thus, each of the emergency broadcast devices 13 starts broadcasting in the building. This broadcasting in the building leads those stranded in the building to move to the floors located below using the emergency stairs 7. Fire detection information is output from the disaster prevention supervisory device 15 to the emergency control device 16.

After that, upon receiving the fire detection information from the disaster prevention supervisory device 15, the emergency control device 16 performs control such that fire emergency operation is performed as to each of the elevators 4 and 5 to stop all the cars at the evacuation floor (S3). After that, the rescue floor setting portion 18 sets the rescue floors (the fourth floor and the seventh floor) for the service zones 2 and 3, respectively (S4). After that, the evacuation operation performability determining portion 20 determines whether or not evacuation operation from each of the rescue floors can be performed, based on information from the disaster prevention supervisory device 15 and information from the rescue floor setting portion 18 (S5).

When it is determined that evacuation operation from each of the rescue floors cannot be performed, the evacuation guidance device-control portion 21 starts controlling that one of the evacuation guidance devices 14 which is installed at that rescue floor (S6). In this case, the emergency control device 16 performs control such that evacuation operation from that rescue floor is not performed, so the corresponding ones of the cars remain stopped at the evacuation floor through fire emergency operation (S7).

On the other hand, when it is determined that evacuation operation from each of the rescue floors can be performed, the evacuation guidance device-control portion 21 also starts controlling that one of the evacuation guidance devices 14 which is installed at that rescue floor (S8).

After that, the evacuation operation command portion 19 issues a command to perform evacuation operation from that rescue floor (S9). During evacuation operation, each of the cars is vertically reciprocated between a corresponding one of the rescue floors and the evacuation floor. Thus, those stranded at that rescue floor of the building are conveyed therefrom to the evacuation floor.

After that, the emergency control device 16 determines whether or not the emergency control device 16 has received a termination command (S10). The emergency control device 16 receives the termination command, for example, when a termination button installed in each of the elevators 4 and 5 is manipulated, when an abnormality detecting sensor installed in each of the elevators 4 and 5 is actuated due to the spread of the fire, the inundation resulting from fire fighting, or the like, or when the absence of people getting on the cars at each of the rescue floors is detected by a boarding/disembarkation sensor or the like. That is, the emergency control device 16 receives the termination command when the continuation of evacuation operation becomes difficult or when a condition for completing evacuation operation is fulfilled.

When it is determined that the emergency control device 16 does not receive the termination command, the control of each of the evacuation guidance devices 14 by the evacuation guidance device-control portion 21 and the performance of evacuation operation from a corresponding one of the rescue floors are continued. When it is determined that the emergency control device 16 receives the termination command, evacuation operation of each of the elevators 4 and 5 is terminated (S11).

Figure 9:
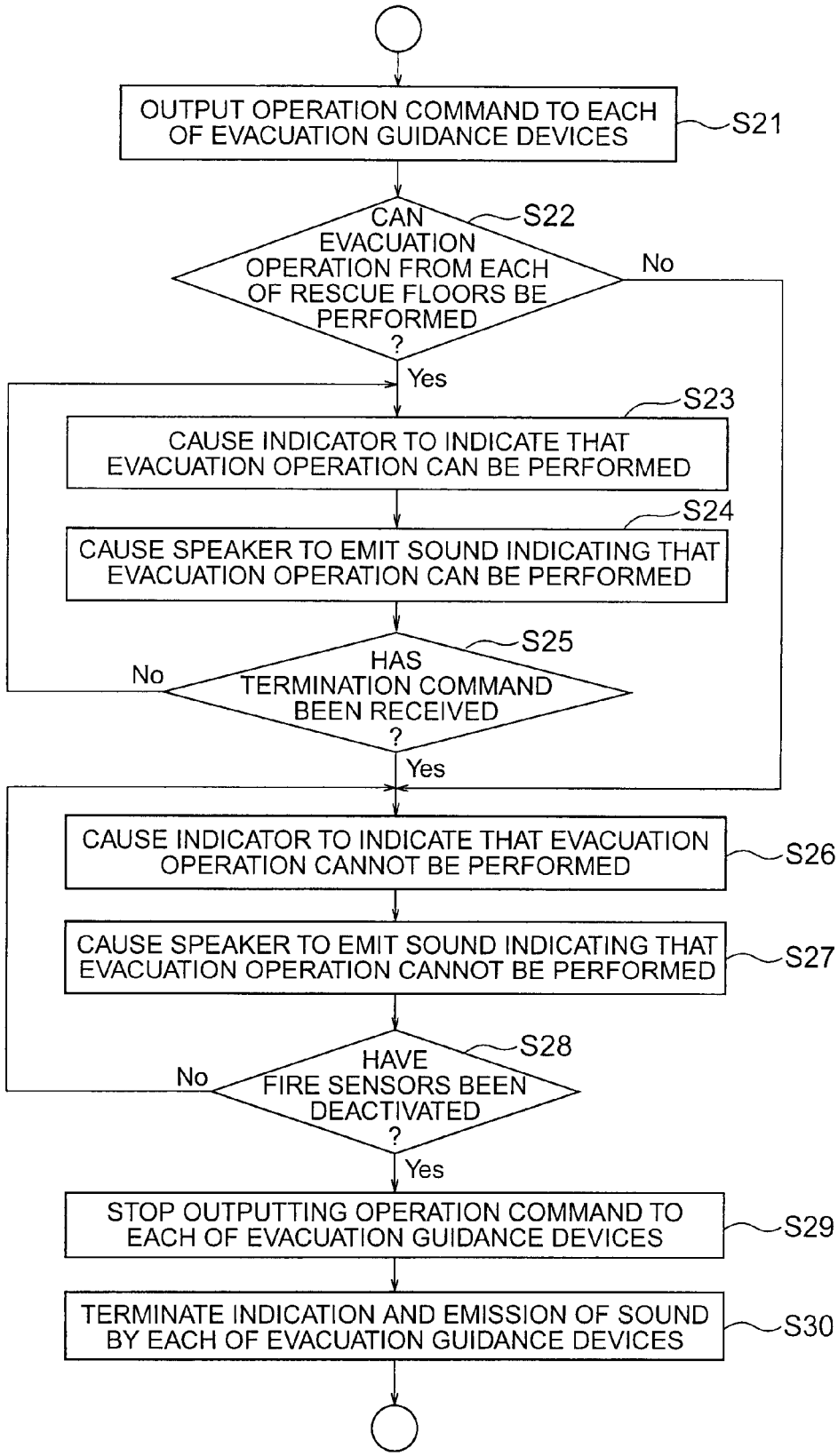
FIG. 9 is a flowchart for explaining the processing operation of the evacuation guidance device-control portion of FIG. 1.

Next, the control performed at the time when the evacuation guidance device-control portion 21 operates each of the evacuation guidance devices 14 will be described. FIG. 9 is a flowchart for explaining the processing operation of the evacuation guidance device-control portion 21 of FIG. 1. As shown in FIG. 9, the evacuation guidance device-control portion 21 outputs an operation command for activating each of the evacuation guidance devices 14 thereto in starting the control thereof (S21). After that, the evacuation guidance device-control portion 21 determines whether or not evacuation operation from a corresponding one of the rescue floors can be performed, based on information from the evacuation operation performability determining portion 20 (S22).

When it is determined that evacuation operation from the corresponding one of the rescue floors can be performed, the evacuation guidance device-control portion 21 causes the corresponding one of the indicators 26 to indicate that the floor is a rescue floor and the evacuation operation from the rescue floor can be performed (S23). At this moment, the evacuation guidance device-control portion 21 causes the corresponding one of the speakers 27 to emit a sound regarding the contents indicated by the corresponding one of the indicators 26 (S24).

After that, the evacuation guidance device-control portion 21 determines whether or not the emergency control device 16 has received the termination command (S25). When it is determined that the emergency control device 16 has not received the termination command, the indication by the corresponding one of the indicators 26 (S23) and the emission of the sound by the corresponding one of the speakers 27 (S24) are continued.

On the other hand, when it is determined that evacuation operation from the corresponding one of the rescue floors cannot be performed and when it is determined that the emergency control device 16 has received the termination command, the evacuation guidance device-control portion 21 causes the corresponding one of the indicators 26 to indicate that the floor is a rescue floor and that evacuation operation from the rescue floor cannot be performed (S26). In this case, the evacuation guidance device-control portion 21 causes the corresponding one of the speakers 27 to emit a sound regarding the contents indicated by the corresponding one of the indicators 26 (S27).

After that, the evacuation guidance device-control portion 21 determines whether or not detection operations of all the fire sensors 12 have been canceled (S28). When it is determined that the detection operations of the fire sensors 12 have not been canceled, the indication by the corresponding one of the indicators 26 (S26) and the emission of the sound by the corresponding one of the speakers 27 (S27) are continued.

When it is determined that the detection operations of all the fire sensors 12 have been canceled, the outputting of the operation command from the evacuation guidance device-control portion 21 to each of the evacuation guidance devices 14 is stopped, so the operation of a corresponding one of the elevators 4 and 5 is changed over from evacuation operation to fire emergency operation (S29). After that, each of the evacuation guidance devices 14 terminates the indication and the emission of the sound (S30).

In the evacuation support apparatus for the elevators configured as described above, each of the predetermined service floors is set as the rescue floor, and each of the evacuation guidance devices 14 installed in the building 1 imparts to those stranded in the building the evacuation information including the information for specifying a corresponding one of the rescue floors, based on the information from the emergency control device 16 for performing evacuation operation to vertically reciprocate each of the cars between a corresponding one of the rescue floors and the evacuation floor. During evacuation operation, therefore, the evacuation information necessary for evacuation, such as the positions of the rescue floors, can be recognized by those stranded in the building, so those stranded in the building can be guided smoothly according to the evacuation information. Thus, the efficiency in conveying those stranded in the building to the evacuation floor can be enhanced.

In the building 1 in which the elevators located on the N banks are provided, the predetermined service floors are specified by vertically separating the building 1 into the (N+1) evacuation zones and setting each of the lowest floors in the N evacuation zones other than the lowest evacuation zone as the predetermined service floor. Therefore, the number of the floors at which each of the cars is stopped can be reduced, so the efficiency in conveying those stranded in the building 1 to the evacuation floor can further be enhanced. An appropriate number of rescue floors corresponding to the number of elevators can be set, and the distances among the rescue floors can also be set appropriately in accordance with the number of floors in the building 1.

Each of the evacuation guidance devices 14 is installed in the stair regions 9 provided with the emergency stairs 7, so those stranded in the building who move by the emergency stairs 7 to be evacuated can recognize the evacuation information more definitely. Thus, those stranded in the building can be guided more smoothly.

Each of the evacuation guidance devices 14 is installed at the rescue floor only, so the number of the evacuation guidance devices 14 can be prevented from increasing. As a result, a reduction in cost can be achieved.

Each of the evacuation guidance devices 14 has a corresponding one of the indicators 26 for indicating the evacuation information and a corresponding one of the speakers 27 for acoustically transmitting the evacuation information. Therefore, those stranded in the building can recognize the evacuation information easily.

The emergency control device 16 has the evacuation operation performability determining portion 20 for determining whether or not evacuation operation can be performed, and each of the evacuation guidance devices 14 imparts to those stranded in the building operation performability information as to whether or not evacuation operation from a corresponding one of the rescue floors can be performed as the evacuation information. Therefore, those stranded in the building can more reliably determine whether or not each of the elevators is available. As a result, those stranded in the building can be guided more reliably.

In the foregoing example, the single rescue floor is set for each of the service zones 2 and 3. However, a plurality of rescue floors may be set for each of the service zones 2 and 3. The number of the rescue floors set for the service zones 2 and 3 may be different from one another. In this case, each of the elevators 4 and 5 performs evacuation operation as to a corresponding one of the rescue floors with the tasks of evacuation operation assigned to the elevator machines. For example, when two rescue floors are set for one service zone, half of the elevator machines perform evacuation operation as to one of the rescue floors, and the other half of the elevator machines perform evacuation operation as to the other rescue floor. In this manner, the rescue floors can be restrained from being crowded with those stranded in the building, and the efficiency in conveying those stranded in the building to the evacuation floor can also be further enhanced.

In the foregoing example, the evacuation guidance device 14 is installed at each of the rescue floors only. However, the evacuation guidance devices 14 may be installed at each of the floors different from the rescue floors. Each of the evacuation guidance devices 14 may also be installed at all the floors. In this case, each of those of the evacuation guidance devices 14 which are installed at the floors different from the rescue floors imparts to those stranded in the building the contents such as "THIS FLOOR IS NOT A RESCUE FLOOR. THE RESCUE FLOORS ARE THE FOURTH FLOOR AND THE SEVENTH FLOOR." as the rescue floor information. The evacuation guidance devices 14 may also impart to those stranded in the building the contents regarding the performability of evacuation operation from the rescue floors as a whole.

In the foregoing example, the evacuation guidance devices 14 is installed in each of the stair regions 9. However, the evacuation guidance devices 14 may also be installed in the elevator regions 8 (e.g., between the stair regions 9 and elevator halls of the elevators 4 and 5), respectively. In this manner, even those stranded in the elevator regions 8 of the building can recognize the evacuation information.

In the foregoing example, the control command from the evacuation guidance device-control portion 21 is transmitted to each of the evacuation guidance devices 14 via the disaster prevention supervisory device 15. However, the control command from the evacuation guidance device-control portion 21 may be directly transmitted to each of the evacuation guidance devices 14.

The evacuation guidance devices 14 may impart to those stranded in the building stair information on the situations on the emergency stairs 7 as the evacuation information, in addition to the rescue floor information and the operation performability information. Mentionable as the stair information are, for example, information on the degree of crowdedness with those stranded in the building (crowdedness information), information as to whether or not the stair regions 9 are pervaded with smoke (smoke pollution information), and the like. In this manner, those stranded in the building can further be prevented from making erroneous decisions in selecting the rescue floors.

The evacuation guidance devices 14 may impart to those stranded in the building elevator information on the situations in the elevators 4 and 5 as the evacuation information, in addition to the rescue floor information and the operation performability information. Mentionable as the elevator information are, for example, information on the degree of crowdedness with those stranded in the building (crowdedness information), information as to whether or not the elevators 4 and 5 are in operation (operating/non-operating state information), and the like. In this manner as well, those stranded in the building can further be prevented from making erroneous decisions in selecting the rescue floors.

The invention claimed is:

1. An evacuation support apparatus for an elevator which controls, in an event of a fire in a building provided with an elevator that is assigned to each of a plurality of floors included in a service zone as service floors, an operation of the elevator to convey those stranded in the building to an evacuation floor, the evacuation support apparatus comprising:

an emergency control device having a rescue floor setting portion for setting at least a predetermined one of the service floors as a rescue floor, and an evacuation operation command portion for controlling the elevator such that evacuation operation is performed to vertically reciprocate a car between the rescue floor and the evacuation floor; and an evacuation guidance device installed in the building, for imparting to those stranded in the building evacuation information including information for specifying the rescue floor, based on information from the emergency control device.

2. An evacuation support apparatus for an elevator according to claim 1, wherein:

the building is provided with elevators identical to the elevator which are located on N banks corresponding to N service zones identical to the service zone, with the floors in each of the N service zones being partially different from the floors in any one of the other service zones; and the predetermined one of the service floors is specified by vertically separating the building into (N+1) evacuation zones, and setting the lowest one of the floors in each of the N evacuation zones other than the lowest one of the evacuation zones as the predetermined one of the service floors.

3. An evacuation support apparatus for an elevator according to claim 1, wherein:

each of the floors is divided into an elevator region in which the elevator is provided and a stair region in which evacuation stairs for helping those stranded in the building to move are provided; and the evacuation guidance device is installed in the stair region.

4. An evacuation support apparatus for an elevator according to claim 1, wherein: the evacuation guidance device is installed only at the stair floor.

5. An evacuation support apparatus for an elevator according to claim 1, wherein the evacuation guidance device has at least one of an indicator for indicating the evacuation information and a sound emitting device for acoustically transmitting the evacuation information.

6. An evacuation support apparatus for an elevator according to claim 1, wherein:

the emergency control device further has an evacuation operation performability determining portion for determining whether or not the evacuation operation can be performed; and the evacuation guidance device imparts to those stranded in the building information as to whether or not the evacuation operation from the rescue floor can be performed as the evacuation information.

7. An evacuation support apparatus for an elevator according to claim 1, wherein the evacuation guidance device imparts to those stranded in the building information on a situation on the evacuation stairs provided in the building as the evacuation information.

* * * * *